US008036704B2

(12) United States Patent
Werner

(10) Patent No.: US 8,036,704 B2
(45) Date of Patent: Oct. 11, 2011

(54) DEVICE FOR WIRELESSLY AND REMOTELY ACTUATING A TRIGGER OF A WEAPON

(76) Inventor: Theodore J. Werner, Huntington Station, NY (US)

( * ) Notice: Subject to any disclaimer, the term of this patent is extended or adjusted under 35 U.S.C. 154(b) by 848 days.

(21) Appl. No.: 12/002,862

(22) Filed: Dec. 19, 2007

(65) Prior Publication Data

US 2009/0158922 A1 Jun. 25, 2009

(51) Int. Cl.
*H04M 1/00* (2006.01)

(52) U.S. Cl. ..... 455/556.1; 455/418; 455/420; 455/41.2; 455/68; 89/127; 89/132; 89/136; 124/31

(58) Field of Classification Search ..... 455/418–420, 455/41.2, 556.1–556.2, 68–69; 89/127, 132, 89/136, 150; 124/31, 32
See application file for complete search history.

(56) References Cited

U.S. PATENT DOCUMENTS

| | | | | |
|---|---|---|---|---|
| 6,323,838 | B1 * | 11/2001 | Thanasack et al. | 345/156 |
| 6,328,651 | B1 * | 12/2001 | Lebensfeld et al. | 463/52 |
| 6,650,283 | B2 * | 11/2003 | Brydges et al. | 342/357.07 |
| 7,542,032 | B2 * | 6/2009 | Kruse | 345/418 |
| 7,574,172 | B2 * | 8/2009 | Clark et al. | 455/39 |
| 2008/0121097 | A1 * | 5/2008 | Rudakevych et al. | 89/28.05 |
| 2009/0241929 | A1 * | 10/2009 | Italia et al. | 124/51.1 |

* cited by examiner

*Primary Examiner* — Tuan A Tran
(74) *Attorney, Agent, or Firm* — Charles E. Baxley

(57) ABSTRACT

A device for wirelessly and remotely actuating a trigger of a weapon. The device includes a transmitting portion and a receiving portion. The transmitting portion selectively generates a signal wirelessly and remotely that is received by the receiving portion, and when activated thereby, the receiving portion selectively engages and actuates the trigger of the weapon.

15 Claims, 2 Drawing Sheets

DEVICE FOR WIRELESSLY AND REMOTELY ACTUATING A TRIGGER OF A WEAPON

1. BACKGROUND OF THE INVENTION

A. Field of the Invention

Figure 1:
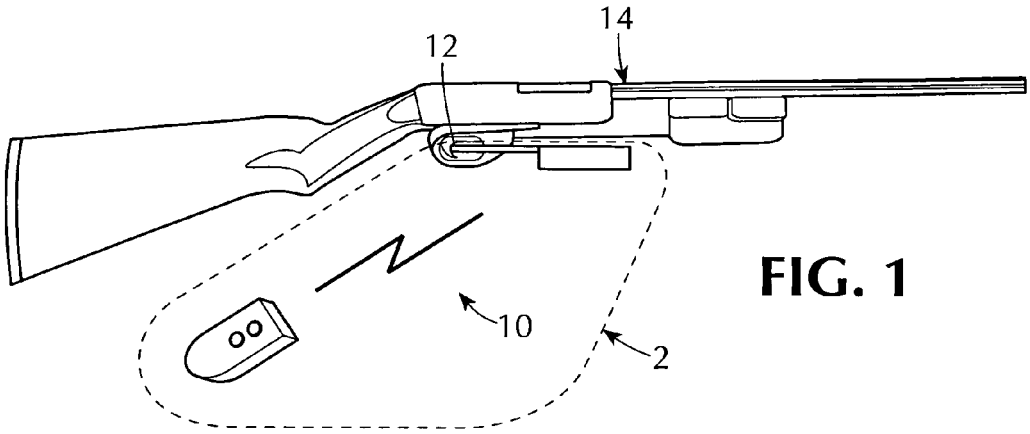

The embodiments of the present invention relate to a device for actuating a trigger of a weapon, and more particularly, the embodiments of the present invention relate to a device for wirelessly and remotely actuating a trigger of a weapon.

B. Description of the Prior Art

Numerous innovations for devices for actuating a trigger of a weapon have been provided in the prior art that will be described below in chronological order to show advancement in the art, and which is incorporated herein by reference thereto. Even though these innovations may be suitable for the specific individual purposes to which they address, however, they differ from the present invention in that they do not teach a device for wirelessly and remotely actuating a trigger of a weapon.

(1) U.S. Pat. No. 499,315 to Borchardt.

U.S. Pat. No. 499,315 issued to Borchardt on Jun. 13, 1893 teaches an automatic shooting rest for breech loading small arms, adjustable in all directions, and including a movable support for the arm moving rearwardly under the recoil thereof, and a bolt-shifter connected to the support and actuated during its movement to open the breech of the arm, and a trigger-finger connected to the support and actuated by the forward movement thereof to fire the gun.

(2) U.S. Pat. No. 4,012,860 to Auger.

U.S. Pat. No. 4,012,860 issued to Auger on Mar. 22, 1977 in class 42 and subclass 94 teaches a lower base and an elongated generally horizontal support member oscillatably supported from the base for angular displacement about a generally horizontal axis. The support member extends in a direction transverse to the axis of oscillation thereof and includes structure spaced above its axis of oscillation for removably stationarily supporting a long gun therefrom with the long gun extending longitudinally of the support member. Adjustment structure is operatively connected between the base and the support member for infinite angular adjustment of the support member relative to the base throughout at least a limited sector of adjustment. In addition, an electric-motor-driven structure for removable support from a long gun supported from the support member and includes features for operative association with the trigger of the associated long gun, whereby the trigger may be gradually actuated without causing vibration of the long gun.

(3) U.S. Pat. No. 4,336,743 to Horn et al.

U.S. Pat. No. 4,336,743 issued to Horn et al. on Jun. 29, 1982 in class 89 and subclass 37 B teaches a gun mount for light automatic weapons, including an upper mount having cradle apparatus for the detachable attachment of the weapon thereto, and a lower mount having a circular track and being adapted to be attached to a vehicle in such a manner that the upper mount is rotated about the vertical axis of the circular track. The cradle is pivotable about a horizontal weapon traverse axis. Aiming apparatus includes a rigid periscope having fixed reflecting mirrors with its eyepiece located below the circular track and whose sight radius is coupled with the traverse motion of the weapon about the weapon traverse axis. The aiming apparatus is about a sight axis that is parallel to the horizontal weapon traverse axis and is attached to a blinder having surface areas that are rotationally symmetrical to the sight axis. A connecting rod having one end pivotable about a first traverse axle parallel to the sight axis and is rigidly connected to the blinder and the other end of the connecting rod is articulated about a second traverse axle on the cradle. The sight axis, the weapon traverse axis, the first traverse axle, and the second traverse axle form the corners of a parallelogram.

(4) U.S. Pat. No. 5,761,954 to Dvorak.

U.S. Pat. No. 5,761,954 issued to Dvorak on Jun. 9, 1998 in class 73 and subclass 167 teaches a device for measuring the entire profile of a firearm's trigger performance. This device may be either hand held or permanently mounted. The device may be connected to a sensor for sensing strike of the firing pin and connected to a computer for graphically and numerically displaying data relating to the firearm's performance. The device is capable of calculating key firearm performance parameters, including lock time and roughness of the trigger profile.

(5) U.S. Pat. No. 6,694,963 to Taylor.

U.S. Pat. No. 6,694,963 issued to Taylor on Feb. 24, 2004 in class 124 and subclass 32 teaches a paint ball gun including a touch-activated trigger system. The touch-activated trigger system preferably can cause the initiation of a firing operation of the paint ball gun in response to contact with human flesh or a specialized glove.

(6) U.S. Pat. No. 7,047,863 to Hawkes et al.

U.S. Pat. No. 7,047,863 issued to Hawkes et al. on May 23, 2006 in class 89 and subclass 37.04 teaches a powered aiming platform for pointing devices, such as firearms, illumination devices, or sensing instruments, remotely controlled by a hand-controller device, with video feedback of the aiming position and audio feedback of the exact direction and speed of positioning movements. The system overcomes the safety and accuracy limitations of manual and conventional remotely-controlled aiming mechanisms, thereby allowing operators to point devices accurately and quickly with predictable, precise control. In the case of firearms, the system maintains a steady position after repeated firing.

(7) U.S. Pat. No. 7,137,220 to Bradley, Jr.

U.S. Pat. No. 7,137,220 issued to Bradley, Jr. on Nov. 21, 2006 in class 42 and subclass 119 teaches a collimating scope for attachment to a rifle so that the scope has an objective lens that is positioned above the barrel of the rifle and an ocular lens that is below the barrel of the rifle and that is proximate the opening of the barrel. A grip extends downwardly from the scope and has a trigger thereon that is mechanically connected to the trigger of the rifle for firing the rifle from the trigger on the grip. A pair of braces, one for the torso of a user, the other for a thigh of the user in order to rest the scope and its attached rifle on the back of a user so that the user may lie prone and below the rifle and be able to scope a target and fire the rifle from this position.

(8) Canadian Patent Number 1099969 to Jackson.

Canadian Patent Number 1099969 issued to Jackson on Apr. 28, 1981 in class 89 and subclass 36 teaches an auxiliary firing mechanism used to actuate a tripper for a gun trigger, including a remote actuator connected to the tripper by an elongated connector, such as a cable, that is moved by the cooperable action of a control member and a rotatably and axially movable actuator member of the actuator. Camming surfaces of the control and the actuator member of the actuator move the control member from a first position to a second position against a spring bias thereof in order to actuate the tripper and thereby trip the gun trigger whereupon the camming surface of the actuator member moves out of engagement with the camming surface of the control member in order to allow the control member to be moved back to the first position by its spring bias. Axial and rotational movement of the actuator member then again engages the camming surfaces of the control and actuator members in preparation for another actuation of the tripper. A manually movable lever, which preferably has a foot pedal, rotates the actuator member to provide the tripper actuation.

(9) Japanese Patent Number 03071217 to Tsunesada.

Japanese Patent Number 03071217 issued to Tsunesada on Aug. 28, 2003 teaches apparatus arranged that the user pulls the trigger by attaching a bellow to the front end of a pipe held in his mouth instead of using other parts (fingers) of his body and expanding the same.

It is apparent that numerous innovations for devices for actuating a trigger of a weapon have been provided in the prior art that are adapted to be used. Furthermore, even though these innovations may be suitable for the specific individual purposes to which they address, however, they would not be suitable for the purposes of the embodiments of the present invention as heretofore described, namely, a device for wirelessly and remotely actuating a trigger of a weapon.

2. SUMMARY OF THE INVENTION

Thus, an object of the embodiments of the present invention is to provide a device for wirelessly and remotely actuating a trigger of a weapon, which avoids the disadvantages of the prior art.

Briefly stated, another object of the embodiments of the present invention is to provide a device for wirelessly and remotely actuating a trigger of a weapon. The device includes a transmitting portion and a receiving portion. The transmitting portion selectively generates a signal wirelessly and remotely that is received by the receiving portion, and when activated thereby, the receiving portion selectively engages and actuates the trigger of the weapon.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

Figure 2:
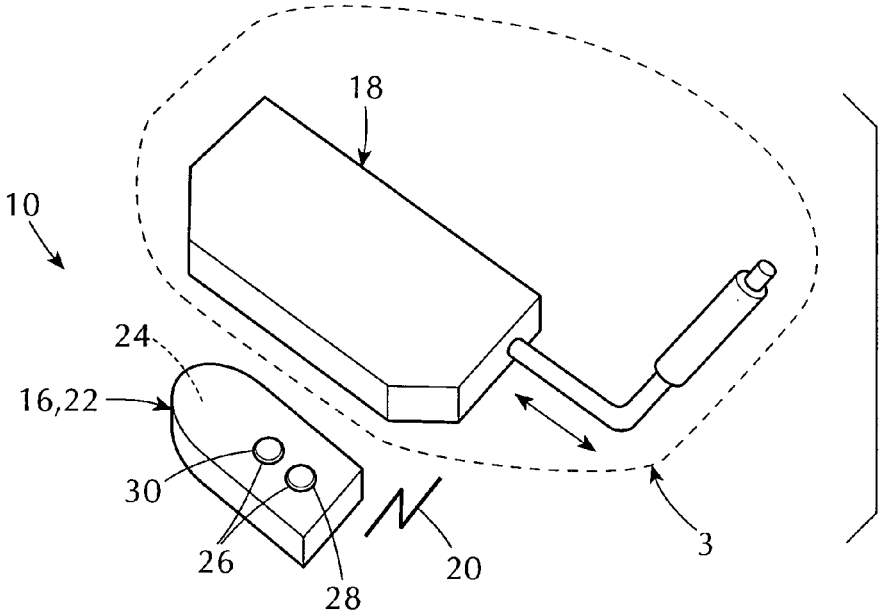
Figure 3:
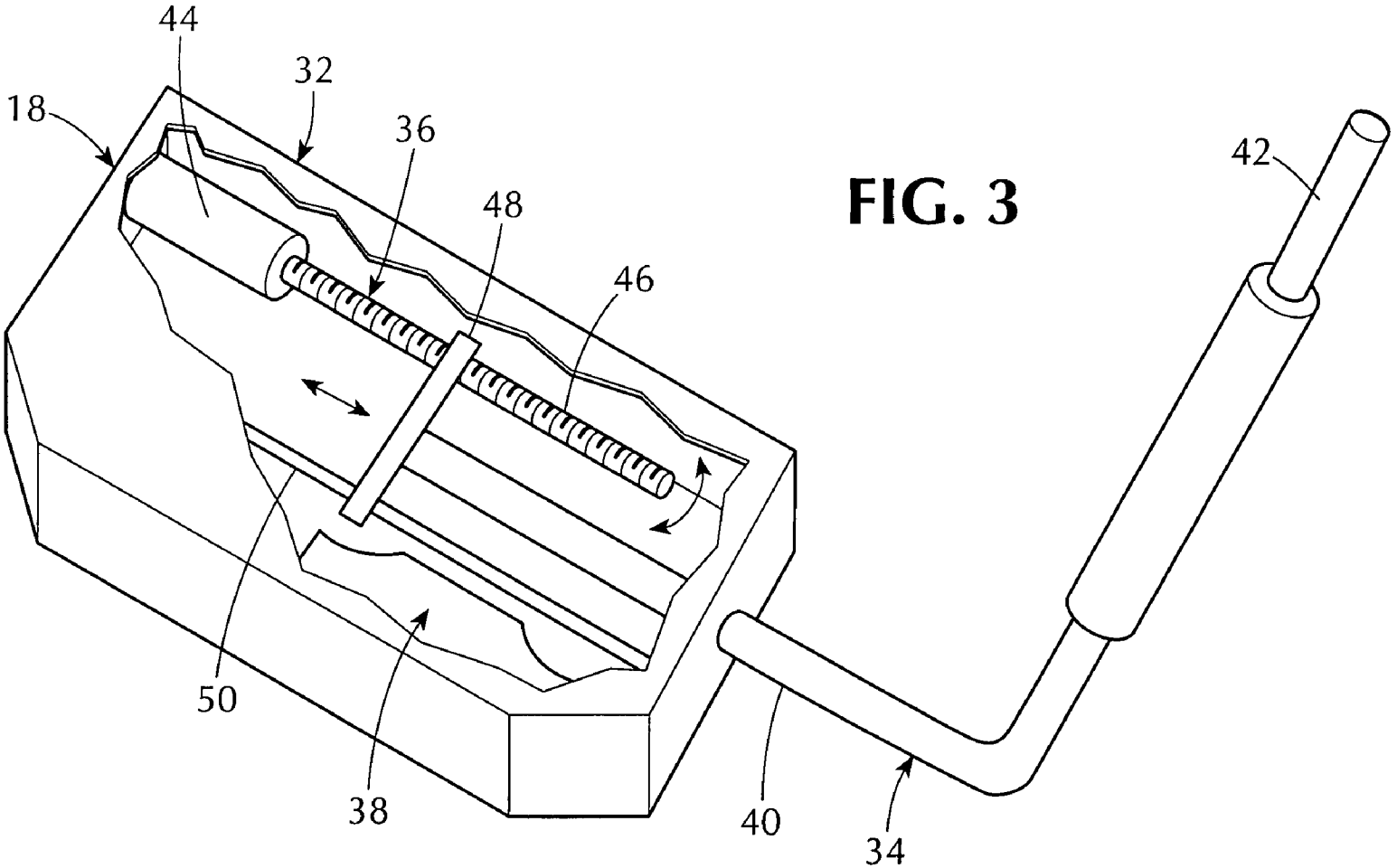

The figures of the drawing are briefly described as follows:

FIG. 1 is a diagrammatic perspective view of the device of the embodiments of the present invention wirelessly and remotely actuating a trigger of a weapon;

FIG. 2 is an enlarged diagrammatic perspective view of the area generally enclosed by the dotted curve identified by ARROW 2 in FIG. 1 of the device of the embodiments of the present invention; and FIG. 3 is an enlarged diagrammatic perspective view with parts broken away of the area generally enclosed by the dotted curve identified by ARROW 3 in FIG. 2 of the receiving portion of the device of the embodiments of the present invention.

4. LIST OF REFERENCE NUMERALS UTILIZED IN THE DRAWING

A. General.

10 device of embodiments of present invention for wirelessly and remotely actuating trigger 12 of weapon 14
12 trigger of weapon 14
14 weapon B. Overall Configuration of Device 10.

16 transmitting portion
18 receiving portion
20 signal
22 key-fob of transmitting portion 16
24 transmitter of transmitting portion 16
26 pair of buttons of transmitting portion 16
28 one button of pair of buttons 26 of transmitting portion 16
30 other button of pair of buttons 26 of transmitting portion 16

C. Specific Configuration of Receiving Portion 18.

32 housing of receiving portion 18
34 rod of receiving portion 18 for selectively engaging and actuating trigger 12 of weapon 14.
36 apparatus of receiving portion 18
38 receiver of receiving portion 18
40 axial portion of rod 34 of receiving portion 18
42 lateral portion of rod 34 of receiving portion 18 for selectively engaging and actuating trigger 12 of weapon 14
44 motor of apparatus 36 of receiving portion 18
46 threaded rod of apparatus 36 of receiving portion 18
48 plate of apparatus 36 of receiving portion 18
50 guide rod of apparatus 36 of receiving portion 18

5. DETAILED DESCRIPTION OF THE PREFERRED EMBODIMENTS

A. General

Referring now to the figures, in which like numerals indicate like parts, and particularly to FIG. 1, which is a diagrammatic perspective view of the device of the embodiments of the present invention wirelessly and remotely actuating a trigger of a weapon, the device of the embodiments of the present invention is shown generally at 10 for wirelessly and remotely actuating a trigger 12 of a weapon 14.

B. The Overall Configuration of the Device 10

The overall configuration of the device 10 can best be seen in FIG. 2, which is an enlarged diagrammatic perspective view of the area generally enclosed by the dotted curve identified by ARROW 2 in FIG. 1 of the device of the embodiments of the present invention, and as such, will be discussed with reference thereto.

The device 10 comprises a transmitting portion 16 and a receiving portion 18. The transmitting portion 16 selectively generates a signal 20 wirelessly and remotely that is received by the receiving portion 18, and when activated thereby, the receiving portion 18 selectively engages and actuates the trigger 12 of the weapon 14.

The transmitting portion 16 is battery-operated and is a key-fob 22.

The transmitting portion 16 contains a transmitter 24 and has a pair of buttons 26 thereon. One button 28 of the pair of buttons 26 of the transmitting portion 16 actuates the receiving portion 18 in one direction, while the other button 30 of the pair of buttons 26 of the transmitting portion 16 actuates the receiving portion 18 in an opposite direction.

C. The Specific Configuration of the Receiving Portion 18

The specific configuration of the receiving portion 18 can best be seen in FIG. 3, which is an enlarged diagrammatic perspective view with parts broken away of the area generally enclosed by the dotted curve identified by ARROW 3 in FIG. 2 of the receiving portion of the device of the embodiments of the present invention, and as such, will be discussed with reference thereto.

The receiving portion 18 comprises a housing 32, a rod 34, apparatus 36, and a receiver 38.

The rod 34 of the receiving portion 18 is movable in and out of the housing 32 of the receiving portion 18 for selectively engaging and actuating the trigger 12 of the weapon 14.

The apparatus 36 of the receiving portion 18 is contained within the housing 32 of the receiving portion 18 and is operatively connected to, and moves, the rod 34 of the receiving portion 18 in and out of the housing 32 of the receiving portion 18.

The receiver 38 of the receiving portion 18 is contained within the housing 32 of the receiving portion 18 and is operatively connected to, and actuates, the apparatus 36 when the receiver 38 of the receiving portion 18 receives the signal 20 generated by the transmitting portion 16.

The rod 34 of the receiving portion 18 is generally L-shaped, and as such, has an axial portion 40 and a lateral portion 42.

The axial portion 40 of the rod 34 of the receiving portion 18 moves axially in and out of the housing 32 of the receiving portion 18, while the lateral portion 42 of the rod 34 of the receiving portion 18 extends normally from the axial portion 40 of the rod 34 of the receiving portion 18 for selectively engaging and actuating the trigger 12 of the weapon 14.

The apparatus 36 of the receiving portion 18 comprises a motor 44, a threaded rod 46, a plate 48, and a guide rod 50.

The motor 44 of the apparatus 36 of the receiving portion 18 is battery-operated and is contained within the housing 32 of the receiving portion 18.

The threaded rod 46 of the apparatus 36 of the receiving portion 18 is movably contained within the housing 32 of the receiving portion 18 and is operatively connected to, to turn with, the motor 44 of the apparatus 36 of the receiving portion 18.

The plate 48 of the apparatus 36 of the receiving portion 18 is movably contained within the housing 32 of the receiving portion 18 and is threadably connected to, to move up and down, the threaded rod 46 of the apparatus 36 of the receiving portion 18, and has the rod 34 of the receiving portion 18 fixedly attached thereto so as to allow the rod 34 of the receiving portion 18 to extend from, and retract into, the housing 32 of the receiving portion 18 to thereby selectively engage and actuate the trigger 12 of the weapon 14.

The guide rod 50 of the apparatus 36 of the receiving portion 18 is fixedly contained within the housing 32 of the receiving portion 18 and has the plate 48 of the apparatus 36 of the receiving portion 18 move up and down thereof, with the rod 34 of the receiving portion 18 positioned between the threaded rod 46 of the apparatus 36 of the receiving portion 18 and the guide rod 50 of the apparatus 36 of the receiving portion 18.

D. The Conclusions

It will be understood that each of the elements described above or two or more together may also find a useful application in other types of constructions differing from the types described above.

While the embodiments of the present invention have been illustrated and described as embodied in a device for wirelessly and remotely actuating a trigger of a weapon, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A device for wirelessly and remotely actuating a trigger of a weapon, comprising:

a) a transmitting portion; and b) a receiving portion;

wherein said transmitting portion selectively generates a signal wirelessly and remotely that is received by said receiving portion, and when activated thereby, said receiving portion selectively engages and actuates said trigger of said weapon; and wherein said receiving portion comprises:

a) a housing;

b) a rod;

c) means for moving said rod of said receiving portion in and out of said housing of said receiving portion; and d) a receiver.

2. The device of claim 1, wherein said transmitting portion is battery-operated.

3. The device of claim 1, wherein said transmitting portion is a key-fob.

4. The device of claim 1, wherein said transmitting portion contains a transmitter.

5. The device of claim 1, wherein said transmitting portion has a pair of buttons thereon;

wherein one button of said pair of buttons of said transmitting portion actuates said receiving portion in one direction; and wherein the other button of said pair of buttons of said transmitting portion actuates said receiving portion in an opposite direction.

6. The device of claim 1, wherein said rod of said receiving portion is movable in and out of said housing of said receiving portion for selectively engaging and actuating the trigger of the weapon.

7. The device of claim 1, wherein said means is contained within said housing of said receiving portion;

wherein said means is operatively connected to said rod of said receiving portion; and wherein said means moves said rod of said receiving portion in and out of said housing of said receiving portion.

8. The device of claim 1, wherein said receiver of said receiving portion is contained within said housing of said receiving portion;

wherein said receiver of said receiving portion is operatively connected to said means; and wherein said receiver of said receiving portion actuates said means when said receiver of said receiving portion receives said signal generated by said transmitting portion.

9. The device of claim 1, wherein said rod of said receiving portion is generally L-shaped;

wherein said rod of said receiving portion has:

a) an axial portion; and b) a lateral portion;

wherein said axial portion of said rod of said receiving portion moves axially in and out of said housing of said receiving portion;

wherein said lateral portion of said rod of said receiving portion extends normally from said axial portion of said rod of said receiving portion; and wherein said lateral portion of said rod of said receiving portion is for selectively engaging and actuating the trigger of the weapon.

10. The device of claim 1, wherein said means includes:

a) a motor;

b) a threaded rod;

c) a plate; and d) a guide rod.

11. The device of claim 10, wherein said motor of said means is battery-operated; and wherein said motor of said means is contained within said housing of said receiving portion.

12. The device of claim 11, wherein said threaded rod of said means is movably contained within said housing of said receiving portion;

wherein said threaded rod of said means is operatively connected to said motor of said means; and wherein said threaded rod of said means turns with said motor of said means.

13. The device of claim 10, wherein said plate of said means is movably contained within said housing of said receiving portion;

wherein said plate of said means is threadably connected to said threaded rod of said means;

wherein said plate of said means moves up and down said threaded rod of said means; and wherein said plate of said means has said rod of said receiving portion fixedly attached thereto so as to allow said rod of said receiving portion to extend from, and retract into, said housing of said receiving portion to thereby selectively engage and actuate the trigger of the weapon.

14. The device of claim 10, wherein said guide rod of said means is fixedly contained within said housing of said receiving portion; and wherein said guide rod of said means has said plate of said means move up and down thereof.

15. The device of claim 10, wherein said rod of said receiving portion is positioned between said threaded rod of said means and said guide rod of said means.

* * * * *